US012760732B2

(12) United States Patent
Sun et al.

(10) Patent No.: US 12,760,732 B2
(45) Date of Patent: Oct. 13, 2026

(54) SCROLL COMPRESSOR

(71) Applicant: Danfoss (Tianjin) Ltd., Tianjin (CN)

(72) Inventors: Yusong Sun, Tianjin (CN); Hang Ye, Tianjin (CN); Xishuang Zhang, Tianjin (CN)

(73) Assignee: DANFOSS (TIANJIN) LTD., Tianjin (CN)

( * ) Notice: Subject to any disclaimer, the term of this patent is extended or adjusted under 35 U.S.C. 154(b) by 0 days.

(21) Appl. No.: 18/725,264

(22) PCT Filed: Dec. 30, 2022

(86) PCT No.: PCT/CN2022/143999
§ 371 (c)(1),
(2) Date: Jun. 28, 2024

(87) PCT Pub. No.: WO2023/125950
PCT Pub. Date: Jul. 6, 2023

(65) Prior Publication Data

US 2025/0067265 A1 Feb. 27, 2025

(30) Foreign Application Priority Data

Dec. 31, 2021 (CN) ..... 202111681281.8
Dec. 31, 2021 (CN) ..... 202123450148.X

(51) Int. Cl.
*F04C 29/02* (2006.01)
*F04C 18/02* (2006.01)

(52) U.S. Cl.
CPC ..... *F04C 29/025* (2013.01); *F04C 18/0215* (2013.01); *F04C 29/028* (2013.01); *F04C 2240/603* (2013.01)

(58) Field of Classification Search
CPC ..... F04C 29/025; F04C 2240/603; F04C 2240/809; F04C 18/0215; F04C 29/023;
(Continued)

(56) References Cited

U.S. PATENT DOCUMENTS 4,289,459 A * 9/1981 Neeley ..... F04B 43/1292 417/477.1
6,450,785 B1 * 9/2002 Dellby ..... F04B 39/0261 417/372
(Continued)

FOREIGN PATENT DOCUMENTS

CN 1840909 A 10/2006
CN 101943156 A 1/2011
(Continued)

OTHER PUBLICATIONS

International Search Report mailed Mar. 26, 2023, in connection with corresponding International Application No. PCT/CN2022/143999 (6 pp., including machine-generated English translation).

*Primary Examiner* — Hoang M Nguyen
(74) *Attorney, Agent, or Firm* — McCormick, Paulding & Huber PLLC

(57) ABSTRACT

A scroll compressor (1000), includes a housing (1200); a first scroll plate (1300) fixed to the housing (1200), the first scroll plate (1300) including a first end plate (1310) and a first scroll wrap (1320); a second scroll plate (1400), the second scroll plate (1400) including a second end plate (1410) and a second scroll wrap (1420), the first scroll wrap (1320) extending from the first end plate (1310) toward the second end plate (1410) and the second scroll wrap (1420) extending from the second end plate (1410) toward the first end plate (1310) such that the second scroll wrap (1420) and the first scroll wrap (1310) fit with each other to form a compression cavity for a compression medium; an electric motor (80); and a screw oil pump (100) driven by the motor (80), wherein the top end of the screw oil pump (100) fits with the second scroll plate (1400) and the lower end of the screw oil pump (100) extends into an oil bath located at the bottom of the housing (1200).

14 Claims, 8 Drawing Sheets

(58) Field of Classification Search
CPC .. F04C 29/028; F16N 2013/205; F16N 7/366; F04B 39/0261
See application file for complete search history.

(56) References Cited

U.S. PATENT DOCUMENTS

| | | | | |
|---|---|---|---|---|
| 2006/0013706 | A1* | 1/2006 | Ishida | F04B 39/0261 417/365 |
| 2006/0222550 | A1 | 10/2006 | Shin et al. | |
| 2009/0035168 | A1* | 2/2009 | Ginies | F04C 29/023 418/94 |
| 2013/0309119 | A1* | 11/2013 | Kim | F04B 39/0261 418/55.6 |
| 2016/0069347 | A1* | 3/2016 | Zhang | F04C 28/28 417/45 |

FOREIGN PATENT DOCUMENTS

| | | | | |
|---|---|---|---|---|
| CN | 201810523 | U | | 4/2011 |
| CN | 102062100 | A | | 5/2011 |
| CN | 103541883 | A | | 1/2014 |
| CN | 103807144 | A | | 5/2014 |
| CN | 203835730 | U | | 9/2014 |
| CN | 206972519 | U | | 2/2018 |
| CN | 109253089 | A | | 1/2019 |
| CN | 209012071 | U | | 6/2019 |
| CN | 110998093 | A | | 4/2020 |
| CN | 111140495 | A | | 5/2020 |
| CN | 210565108 | U | | 5/2020 |
| CN | 111441957 | A | | 7/2020 |
| CN | 217233794 | U | | 8/2022 |
| EP | 1876357 | A1 | | 1/2008 |
| JP | H0681791 | A | * | 3/1994 |
| JP | 2000337278 | A | | 12/2000 |
| JP | 2002168183 | A | | 6/2002 |
| KR | 20060023277 | A | * | 3/2006 |

* cited by examiner

SCROLL COMPRESSOR

CROSS-REFERENCE TO RELATED APPLICATIONS

This application is a National Stage application of International Patent Application No. PCT/CN2022/143999, filed on Dec. 30, 2022, which claims priority to Chinese Patent Applications No. 202111681281.8, filed on Dec. 31, 2021, and No. 202123450148.X, filed on Dec. 31, 2021, each of which is hereby incorporated by reference in its entirety.

TECHNICAL FIELD

The present application relates to a compressor.

BACKGROUND

In a compressor, an oil pump is usually used to pump oil from the oil bath to corresponding components of the compressor to, for example, lubricate bearings and scrolls. Existing oil pumps all have shortcomings to varying degrees. As an example, a gear oil pump has a complex structure and a relatively high manufacturing cost. After a long time of use, the oil pumping effect will decrease due to wear between the gears. Another example is the centrifugal pump. Although it is simple to be manufactured and has good reliability, the oil pumping ability is poor when it runs at low speeds, which cannot support the operation of the compressor at relatively low speeds.

SUMMARY

The embodiments of the present application are intended to solve one or more of the above technical problems.

According to one aspect of the present application, a scroll compressor is provided, comprising: a shell; a first scroll fixed to the shell, the first scroll comprising a first end plate and a first scroll wrap; a second scroll, the second scroll comprising a second end plate and a second scroll wrap, and the first scroll wrap extending from the first end plate toward the second end plate, and the second scroll wrap extending from the second end plate toward the first end plate, such that the second scroll wrap and the first scroll wrap fit with each other to form a compression cavity for compressing a medium; an electric motor; and a screw oil pump driven by the electric motor, the top end of the screw oil pump fitting with the second scroll, and the lower end of the screw oil pump extending into an oil bath located at the bottom of the shell.

According to one aspect of the present application, the screw oil pump comprises: a shaft, which is connected to the electric motor to be rotated and is provided with a first channel extending along the entire length of the shaft for oil feeding, the top end of the shaft being fixed to the second end plate; a feeding piece, which is provided with a spirally rising thread; and a cylindrical accommodating piece which accommodates the feeding piece with a gap between it and the feeding piece, wherein one of the feeding piece and the accommodating piece is fixed to the shaft, and the other one of the feeding piece and the accommodating piece is fixed in the shell, such that oil is fed along the thread into the first channel when the feeding piece and the accommodating piece rotate relatively to each other.

According to one aspect of the present application, the bottom end of the shaft is provided with a first fitting groove that has a shape fitting with the top end of the feeding piece, such that the feeding piece is fixed to the bottom end of the shaft in an interference fit manner.

According to one aspect of the present application, the feeding piece is provided with: a through hole, located in a sidewall of the feeding piece and adjacent to the thread; and a second channel, fluidly connecting the through hole to the first channel.

According to one aspect of the present application, the accommodating piece is provided with a first radial protrusion on an inner sidewall thereof, and the bottom end of the shaft inserted into the accommodating piece abuts against the end surface of the first radial protrusion; and the accommodating piece further comprises a rolling bearing between the inner sidewall of the accommodating piece and the bottom end of the shaft.

According to one aspect of the application, the through hole is at the same level as the end surface.

According to one aspect of the present application, the compressor further comprises a bracket, and the accommodating piece further comprises: a flange, extending radially outward from an outer sidewall of the accommodating piece and provided with bolt holes for bolting to the bracket of the compressor.

According to one aspect of the present application, the accommodating piece is provided with a second radial protrusion, and the bottom end of the shaft is provided with a second fitting groove that has a shape fitting with the second radial protrusion, such that the accommodating piece is fixed to the bottom end of the shaft in an interference fit manner.

According to one aspect of the present application, the scroll compressor further comprises: a fixing bracket, fixed at the bottom of the shell and provided with a fixing groove, the fixing groove being used to accommodate and fix a fixing portion provided at the bottom of the feeding piece.

According to an aspect of the present application, the fixing bracket is provided with a first fixing hole, the fixing portion is provided with a second fixing hole, and, when the fixing portion is located in the fixing groove, the first fixing hole and the second fixing hole are aligned with each other, so that a pin is inserted into the first fixing hole and the second fixing hole to fix the fixing portion in the fixing groove.

According to one aspect of the application, the shaft is further provided with an outlet in fluid connection with the first channel for feeding oil in the first channel to a component to be lubricated.

According to one aspect of the application, the thread spirally rises in a direction consistent with the direction along which the shaft rotates.

According to one aspect of the present application, the feeding piece is made of metal or engineering plastics.

According to one aspect of the present application, the electric motor is connected to a frequency converter through a terminal and a lead, and the frequency converter controls the rotation speed of the electric motor.

According to one aspect of the present application, the electric motor comprises a stator and a rotor, the stator being fixed in the shell, and the rotor being located inside the stator and connected to the shaft to drive the shaft to rotate.

BRIEF DESCRIPTION OF THE DRAWINGS

Preferred embodiments of the present application will now be described by way of examples with reference to the accompanying drawings, in which.

DETAILED DESCRIPTION

The technical solutions of the present application will be further described in detail below through the embodiments and in conjunction with the accompanying drawings. In the description, identical or similar reference signs denote identical or similar components. The following description of the embodiments of the present application with reference to the drawings is intended to explain the general invention concept of the present application, and should not be understood as a limitation on the present application.

In addition, in the following detailed description, for convenience of explanation, numerous specific details are set forth in order to provide a thorough understanding of the embodiments disclosed. Obviously, however, one or more embodiments may be implemented without these specific details. In other cases, commonly-known structures and devices are shown as graphical representations to simplify the drawings.

Figure 1:
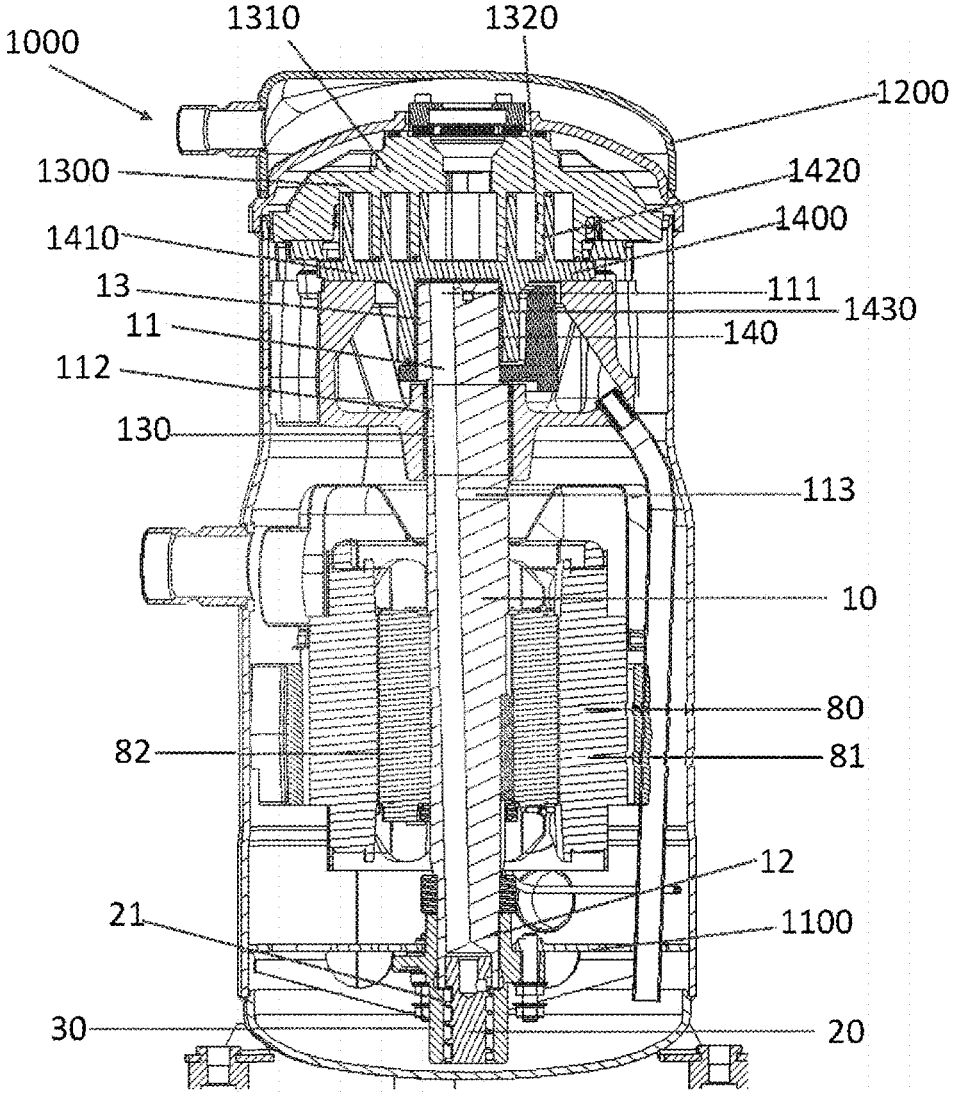
FIG. 1 is a sectional view of the compressor according to one embodiment of the present application.
Figure 2:
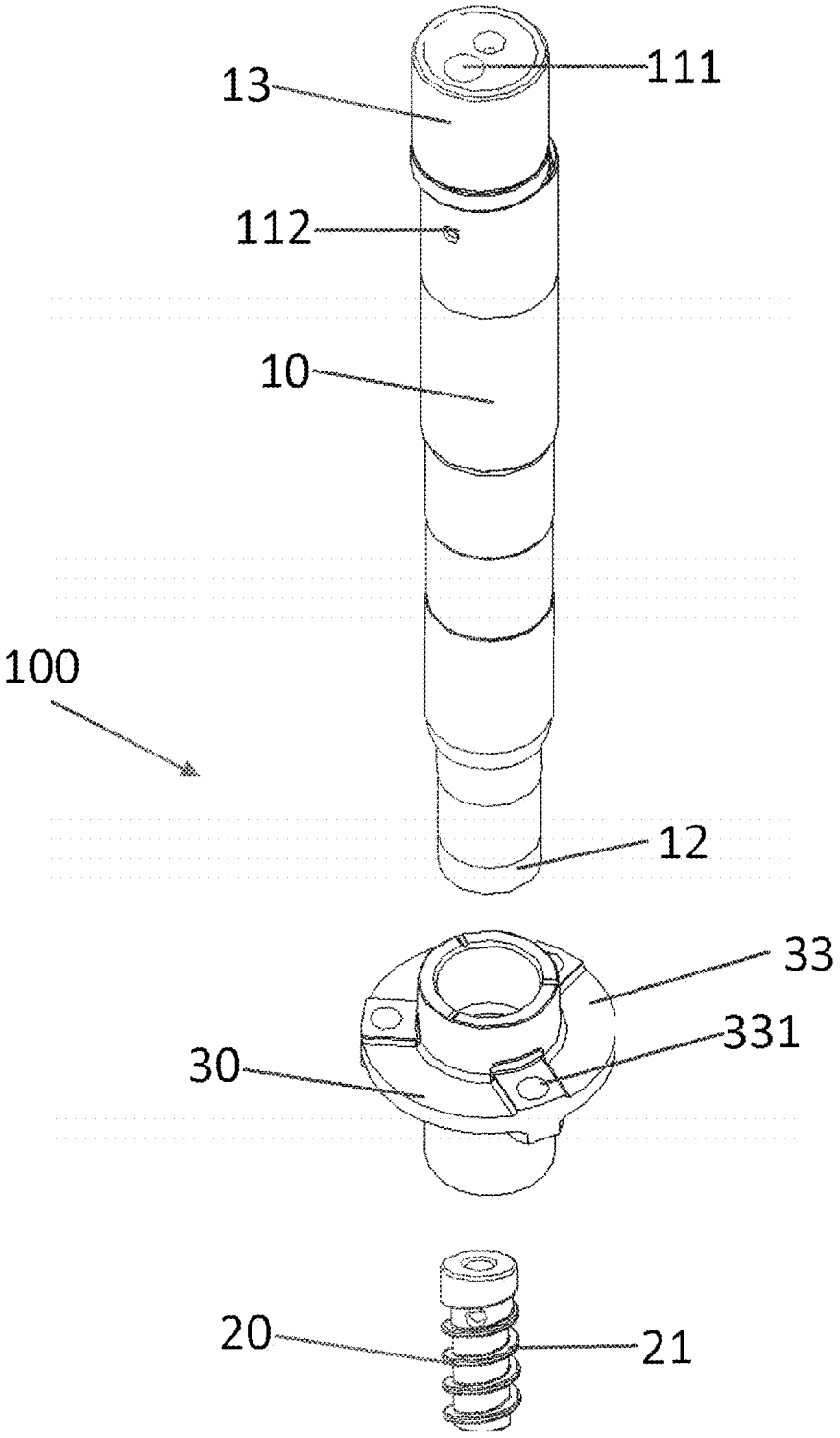
FIG. 2 is a separate 3D exploded view of the screw oil pump installed in the compressor shown in FIG. 1.
Figure 5:
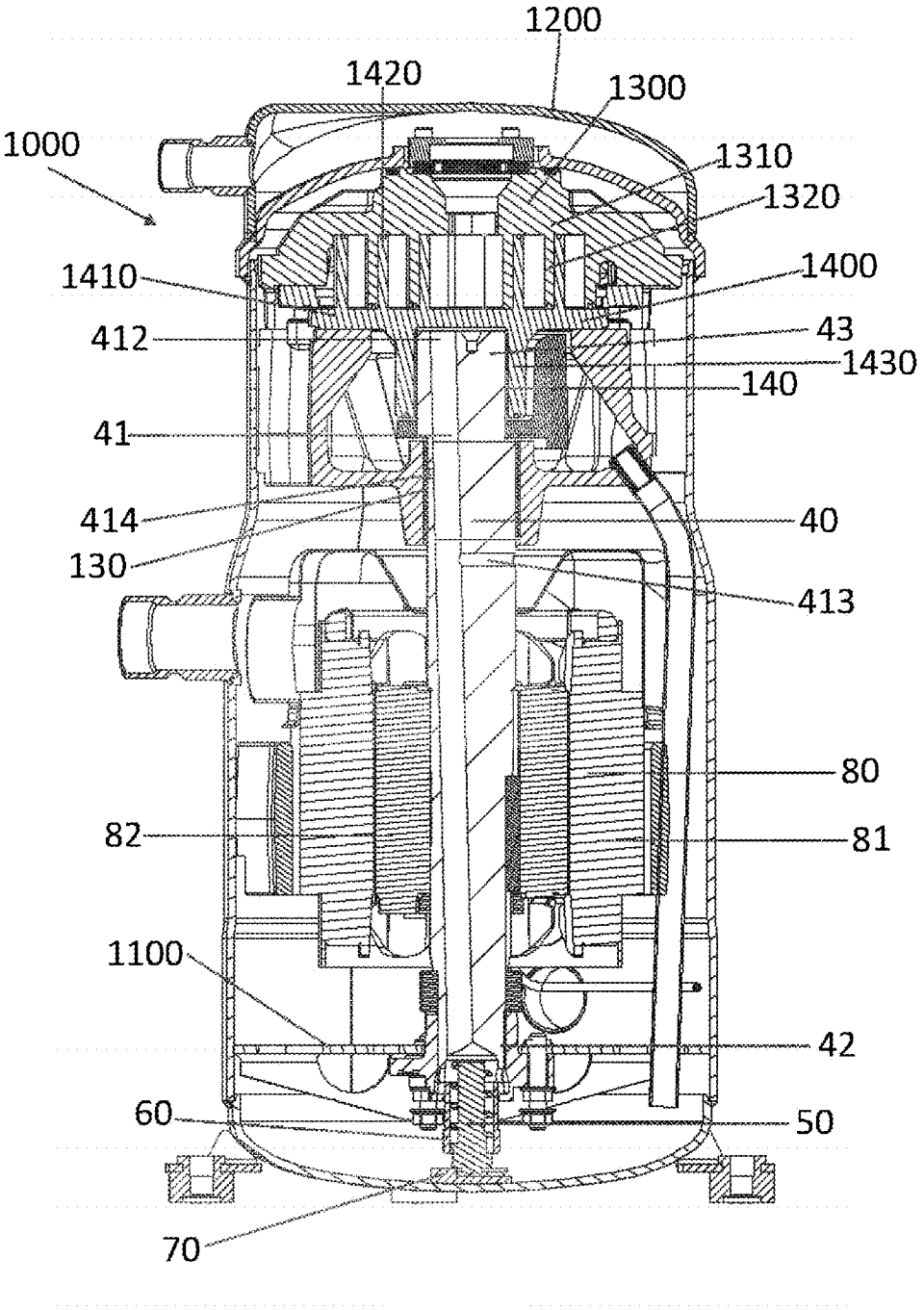
FIG. 5 is a sectional view of the compressor according to another embodiment of the present application.

Referring to FIGS. 1 and 5, a compressor 1000 is provided. The compressor 1000 comprises a shell 1200 and the following components located in the shell 1200: a first scroll 1300 fixed to the shell 1200, a second scroll 1400, an electric motor 80, a bracket 1100, and a screw oil pump 100 or a screw oil pump 200.

The first scroll 1300 comprises a first end plate 1310 and a first scroll wrap 1320, and the second scroll 1400 comprises a second end plate 1410 and a second scroll wrap 1420. The first scroll wrap 1320 extends from the first end plate 1310 toward the second end plate 1410 and the second scroll wrap 1420 extends from the second end plate 1410 toward the first end plate 1310, such that the second scroll wrap 1420 and the first scroll wrap 1320 fit with each other to form a compression cavity for compressing a medium (a gas here).

The electric motor 80 is connected to a frequency converter (not shown in the figures) through a terminal and a lead, and the frequency converter controls the rotation speed of the electric motor 80. The electric motor 80 comprises a stator 81 fixed in the shell 1200 and a rotor 82 which is located inside the stator 81 and which can rotate.

Refer to FIGS. 1 to 4 for a description of the screw oil pump 100 according to one embodiment of the present application.

The screw oil pump 100 is driven by the electric motor 80. The top end of the screw oil pump 100 fits with the second scroll 1400, and the lower end of the screw oil pump 100 extends into an oil bath located at the bottom of the shell 1200. The screw oil pump 100 comprises: a shaft 10, a feeding piece 20 and a cylindrical accommodating piece 30. The top end 13 of the shaft 10 fits with a hub 1430 of the second scroll 1400 that protrudes in a direction away from the first scroll 1300. The shaft 10 is connected to the rotor 82 to be driven to rotate by the rotor 82 so as to drive the second scroll 1400 to rotate. The shaft 10 is provided with a first channel 11 extending along the entire length of the shaft 10 for feeding oil. The first channel 11 extends from the bottom end 12 of the shaft 10 to the top end 13 of the shaft 10. The feeding piece 20 is made of metal or engineering plastics and is provided with a spirally rising thread 21, and the thread 21 rises spirally in a direction consistent with the direction along which the shaft 10 rotates. The accommodating piece 30 accommodates the feeding piece 20 with a gap between it and the feeding piece 20, and the bottom ends of the accommodating piece 30 and the feeding piece 20 are aligned with each other and are both located in the oil bath located at the bottom of the shell 1200. The feeding piece 20 is fixed to the shaft 10, and the accommodating piece 30 is fixed in the shell 1200, such that oil is fed to the first channel 11 along the thread 21 when the feeding piece 20 and the accommodating piece 30 rotate relative to each other. Since there is a gap between the accommodating piece 30 and the feeding piece 20, wear between the feeding piece 20 and the accommodating piece 30 during relative rotation is effectively avoided, effectively improving the reliability of the screw oil pump 100 and the oiling efficiency of the compressor 1000, extending the service life of the screw oil pump 100, and reducing the oil cost of the compressor 1000.

The bottom end 12 of the shaft 10 is provided with a first fitting groove 121 that has a shape fitting with the top end of the feeding piece 20, such that the feeding piece 20 is fixed to the bottom end 12 of the shaft 10 in an interference fit manner to rotate along with the shaft 10. In this way, since the accommodating piece 30 is fixed in the compressor 1000, there is relative rotation between the accommodating piece 30 and the feeding piece 20, such that oil passes through the gap between the accommodating piece 30 and the feeding piece 20, is moved upward along the thread 21 via the first channel 11 along the shaft 10 to be fed to relevant components of the compressor 1000.

Figure 3:
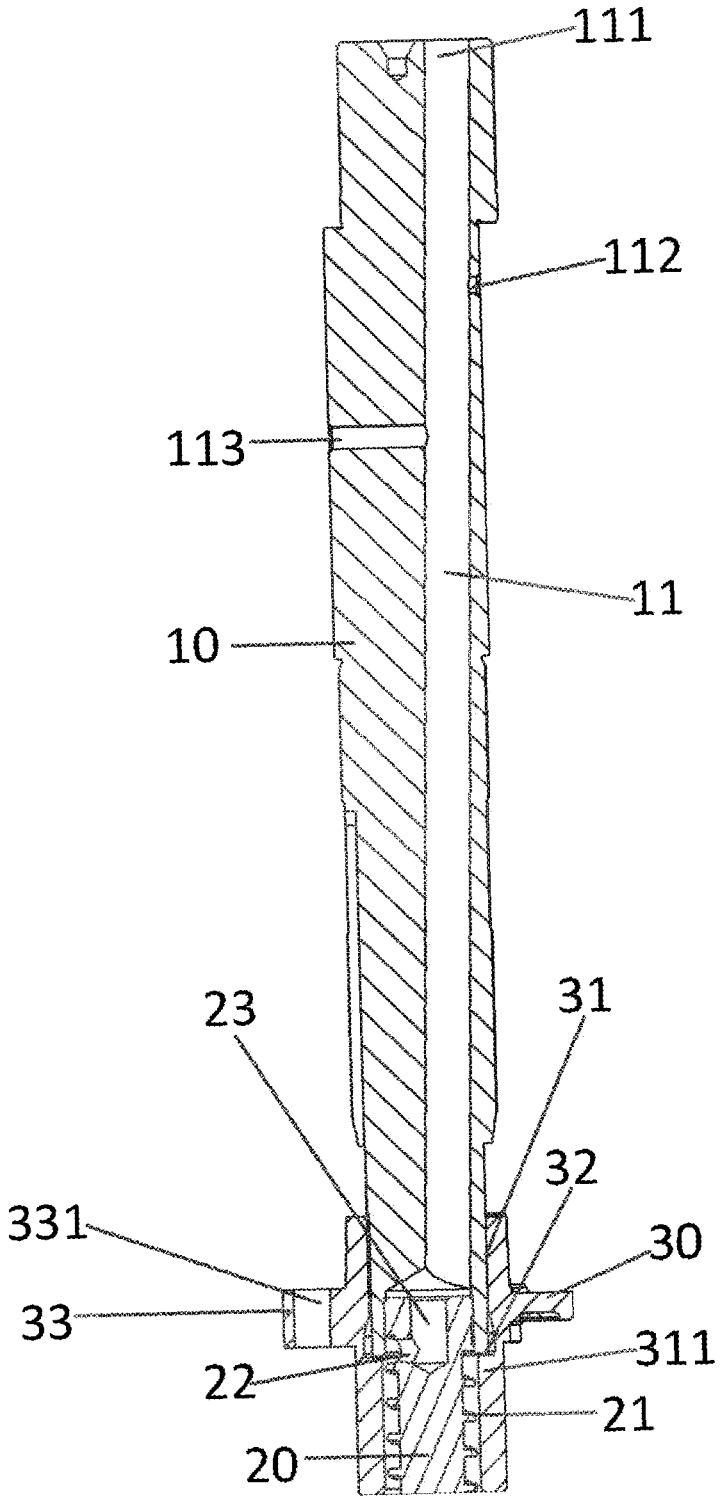
FIG. 3 is a separate sectional view of the screw oil pump installed in the compressor shown in FIG. 1.
Figure 4:
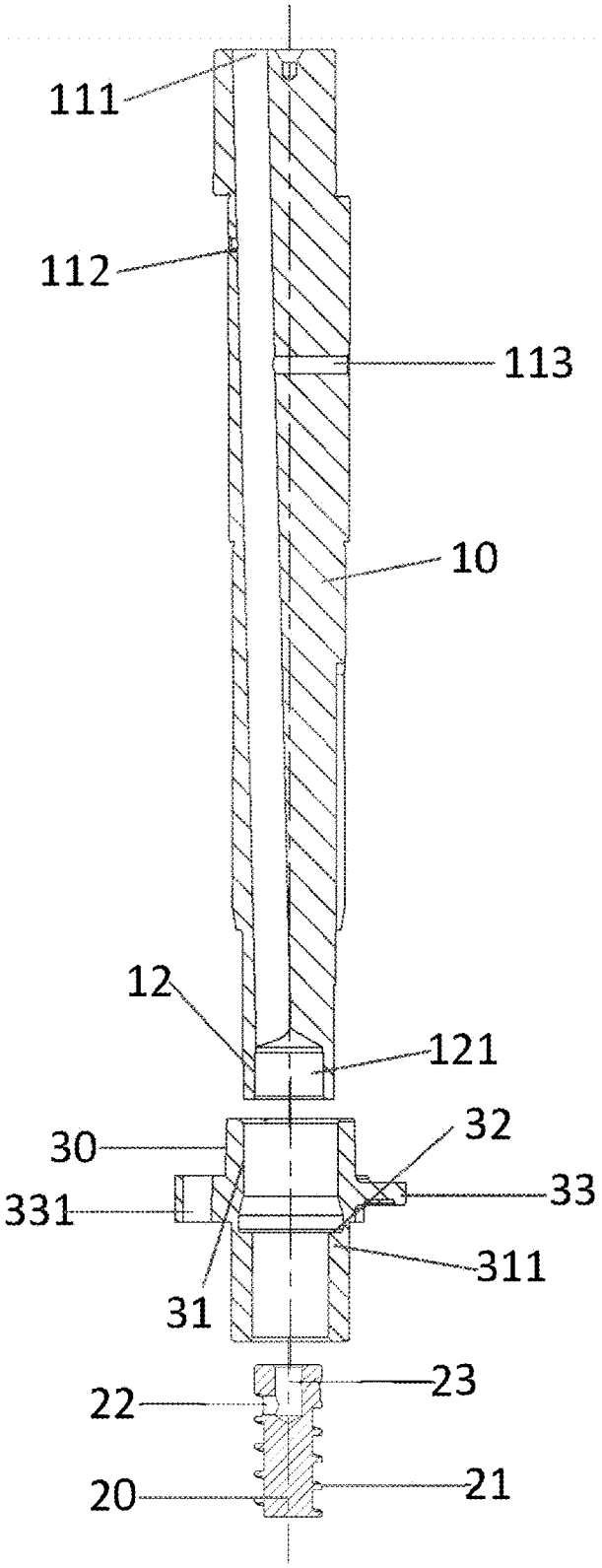
FIG. 4 is a sectional exploded view of the screw oil pump shown in FIG. 2.

Referring to FIGS. 3 and 4, in order to feed oil into the first channel 11 of the shaft 10, a through hole 22, which is located in the sidewall of the feeding piece 20 and is adjacent to the thread 21, and a second channel 23 fluidly connecting the through hole 22 to the first channel 11 are provided in the feeding piece 20. However, those skilled in the art should understand that the present application is not limited thereto, and any suitable structure for feeding oil into the first channel 11 of the shaft 10 may be adopted.

Referring to FIGS. 3 and 4, the accommodating piece 30 is provided with a first radial protrusion 311 on the inner sidewall thereof, and the bottom end 12 of the shaft 10 inserted into the accommodating piece 30 abuts against an upward-facing end surface 32 of the first radial protrusion 311 to be supported by the end surface 32. To make it easier for the bottom end 12 of the shaft 10 to rotate in the accommodating piece 30, a rolling bearing 31 is provided between the inner sidewall of the accommodating piece 30 and the bottom end 12 of the shaft 10, to reduce friction between the bottom end 12 of the shaft 10 and the inner sidewall of the accommodating piece 30. The through hole 22 and the end surface 32 of the first radial protrusion 311 are located at the same level, such that the through hole 22 and the end surface of the bottom end 12 of the shaft 10 are located at the same level, so that oil can flow into the second channel 23 and first channel 11 through the through hole 22.

Referring to FIGS. 1 to 4, the accommodating piece 30 further comprises: a flange 33, extending radially outward from the outer sidewall of the accommodating piece 30 and provided with bolt holes 331 for bolting to the bracket 1100 of the compressor 1000. However, those skilled in the art should understand that the present application is not limited thereto, and any suitable structure that fixes the accommodating piece 30 to the compressor 1000 may be adopted.

The screw oil pump 200 according to another embodiment of the present application will be described below with reference to FIGS. 5 to 8.

The screw oil pump 200 is driven by the motor 80. The top end of the screw oil pump 200 fits with the second scroll 1400, and the lower end of the screw oil pump 200 extends into an oil bath located at the bottom of the shell 1200. The screw oil pump 200 comprises: a shaft 40, a feeding piece 50 and a cylindrical accommodating piece 60. The top end 43 of the shaft 40 fits with the hub 1430 of the second scroll 1400 that protrudes in a direction away from the first scroll 1300. The shaft 40 is connected to the rotor 82 to be driven to rotate by the rotor 82 so as to drive the second scroll 1400 to rotate. The shaft 40 is provided with a first channel 41 extending along the entire length of the shaft 40 for feeding oil. The first channel 41 extends from the bottom end 42 of the shaft 40 to the top end 43 of the shaft 40. The feeding piece 50 is made of metal or engineering plastics and is provided with a spirally rising thread 51, and the thread 51 rises spirally in a direction consistent with the direction along which the shaft 40 rotates. The accommodating piece 60 accommodates the feeding piece 50 with a gap between it and the feeding piece 50, and the bottom ends of the accommodating piece 60 and the feeding piece 50 are aligned with each other and are both located in the oil bath located at the bottom of the shell 1200. The accommodating piece 60 is fixed to the shaft 40, and the feeding piece 50 is fixed in the shell 1200, such that oil is fed to the first channel 41 along the thread 51 when the feeding piece 50 and the accommodating piece 60 rotate relatively to each other. Since there is a gap between the accommodating piece 60 and the feeding piece 50, wear between the feeding piece 50 and the accommodating piece 60 during relative rotation is effectively avoided, thus effectively improving the reliability of the screw oil pump 200 and the oiling efficiency of the compressor 1000, extending the service life of the screw oil pump 200, and reducing the oil cost of the compressor 1000.

Figure 7:
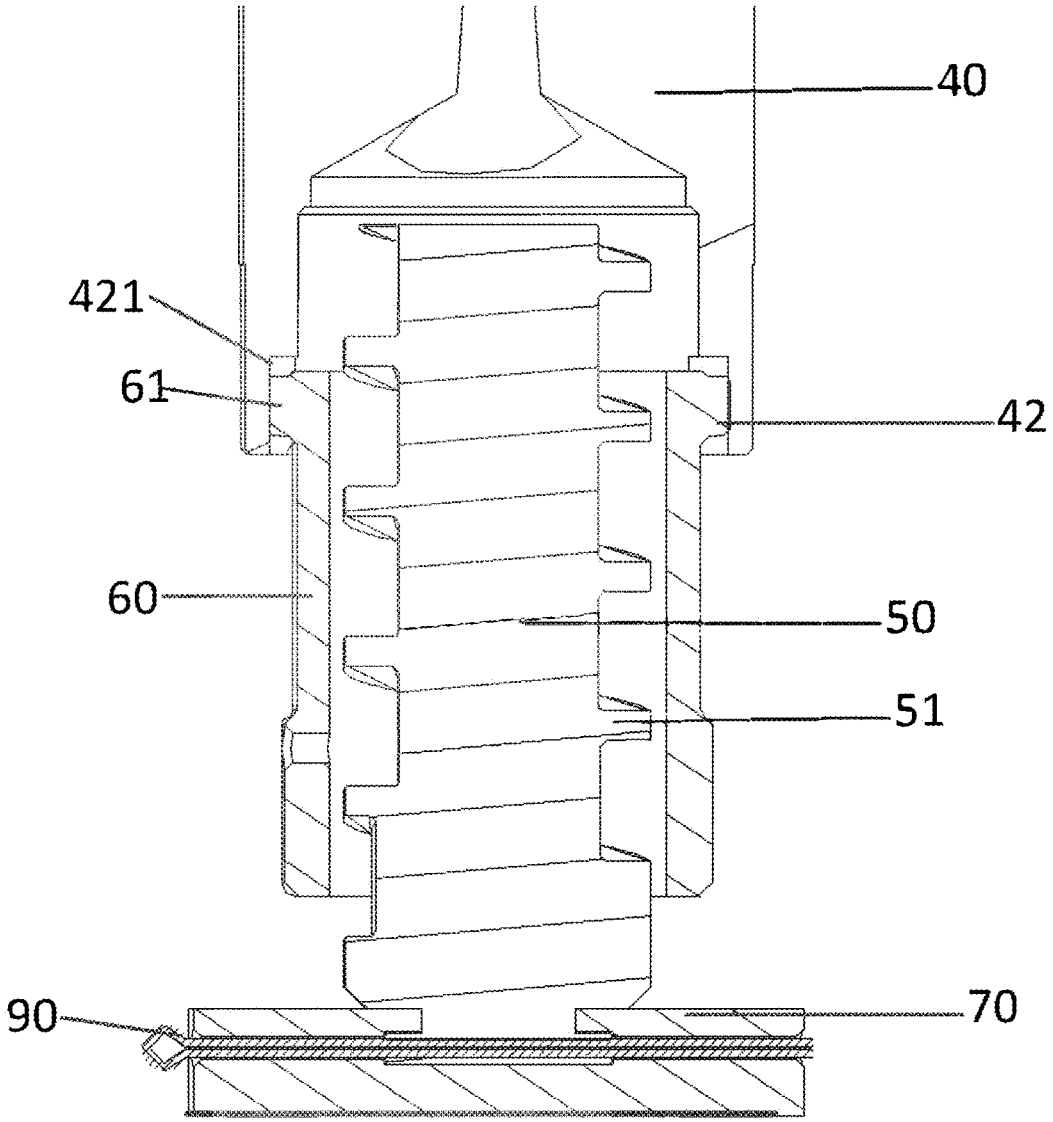
FIG. 7 is a separate enlarged sectional view of the lower part of the screw oil pump installed in the compressor shown in FIG. 5.

As shown in FIG. 7, the accommodating piece 60 is provided with a second radial protrusion 61, and the bottom end 42 of the shaft 40 is provided with a second fitting groove 421 that has a shape fitting with the second radial protrusion 61, such that the accommodating piece 60 is fixed to the bottom end 42 of the shaft 40 in an interference fit manner. However, any suitable structure that fixes the accommodating piece 60 to the shaft 40 may be adopted.

Figure 8:
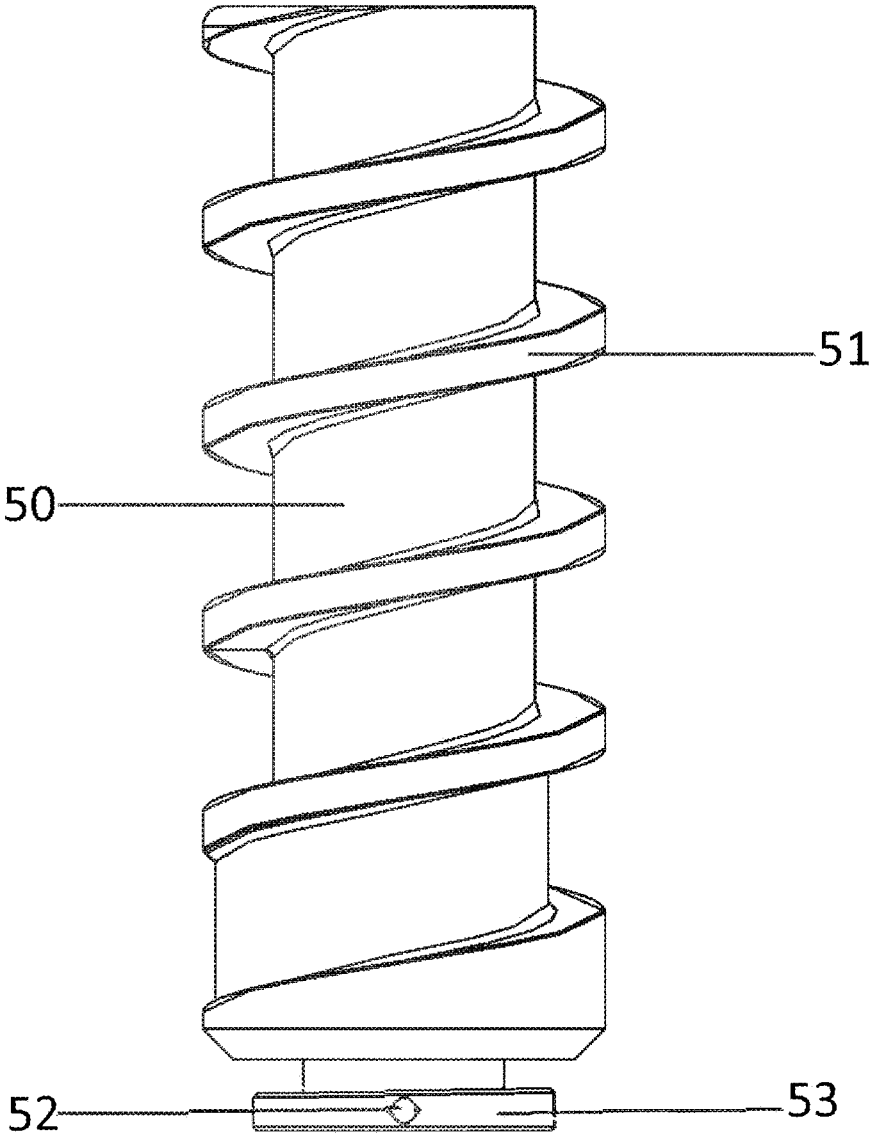
FIG. 8 is a front view of the feeding piece of the screw oil pump shown in FIG. 6.

To fix the feeding piece 50 in the compressor 1000, a substantially circular fixing bracket 70 is provided in the compressor 1000. The fixing bracket 70 is fixed at the bottom of the shell 1200 of the compressor 1000 and is provided with a radially extending fixing groove 71. The fixing groove 71 is used to accommodate and fix the fixing portion 53 provided at the bottom of the feeding piece 50, as shown in FIG. 8. FIG. 5 shows that the fixing bracket 70 is fixed to the bottom of the shell 1200 of the compressor 1000. However, this is not limiting. In other embodiments, the fixing bracket 70 may also be fixed to a portion of the bracket 1100 (for example, a portion extending downward from the bracket 1100).

Figure 6:
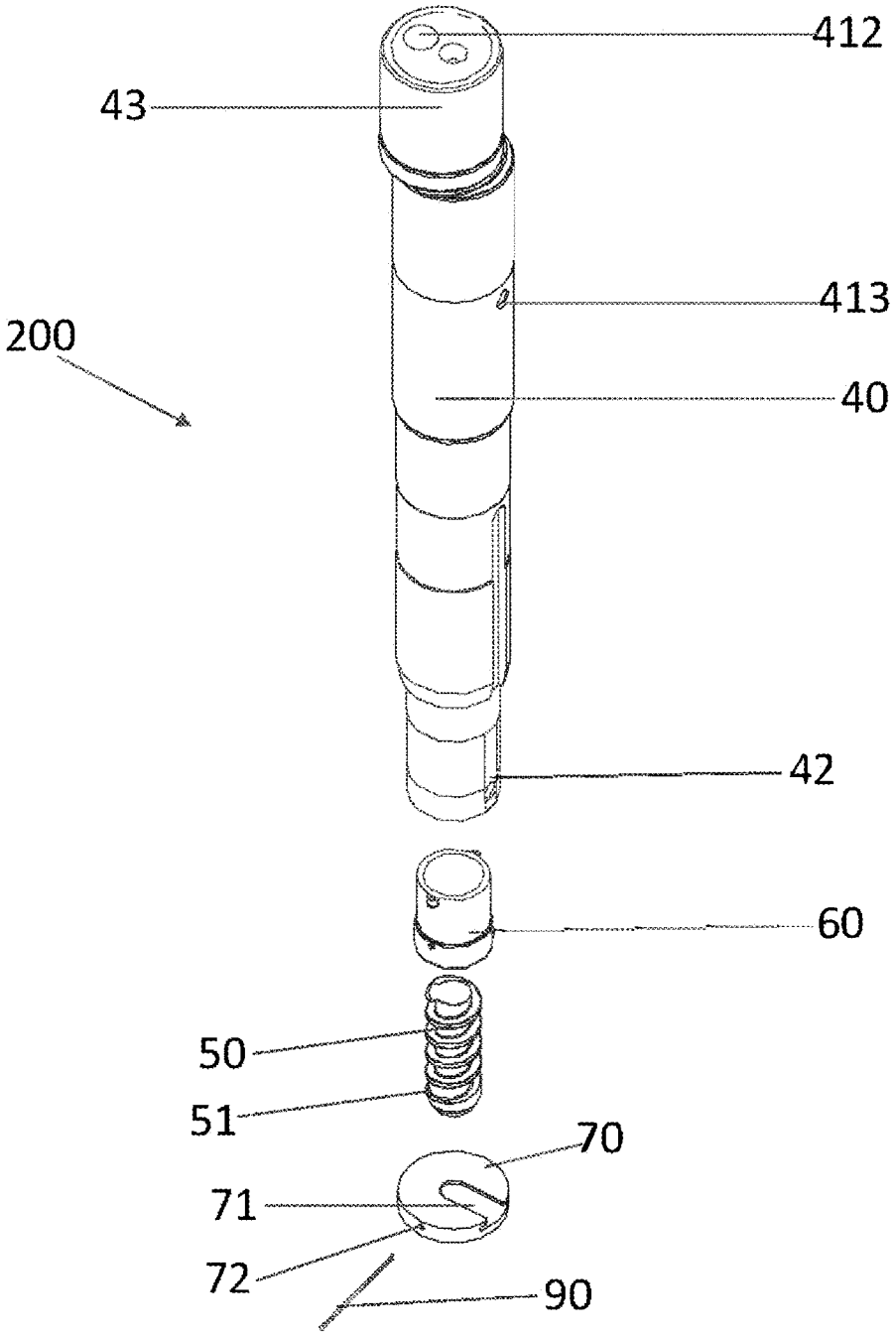
FIG. 6 is a separate 3D exploded view of the screw oil pump installed in the compressor shown in FIG. 5.

Referring to FIGS. 6 to 8, the fixing bracket 70 is provided with a first fixing hole 72 orthogonal to the extension direction of the fixing groove 71, the fixing portion 53 is provided with a second fixing hole 52, and, when the fixing portion 53 is located in the fixing groove 71, the first fixing hole 72 and the second fixing hole 52 are aligned with each other, such that a pin 90 is inserted into the first fixing hole 72 and the second fixing hole 52 to fix the fixing portion 53 in the fixing groove 71.

To feed oil to relevant components of the compressor 1000, the shafts 10 and 40 are further provided with outlets 111, 112, 113; 412, 413 and 414 in fluid connection with the first channels 11 and 41. Referring to FIGS. 1, 3, 5 and 6. For example, oil flowing out from the outlets 111 and 412 located at the top ends 13 and 43 of the shafts 10 and 40 is used to lubricate the second scroll 400 of the compressor 1000, the rolling bearing 140 located between the second scroll 400 and the shafts 10 and 40, and a frame thrust surface; oil flowing out from the outlets 112 and 414 is used to lubricate the main bearing 130 of the frame of the compressor 1000; oil flowing out from the outlets 113 and 413 is used to cool the electric motor 80 of the compressor 1000.

Those skilled in the art can understand that the embodiments described above are all exemplary and can be improved by those skilled in the art. The structures described in the various embodiments may be freely combined as long as there is no conflict in structure or principle.

After a detailed description of the embodiments of the present application, those skilled in the art can clearly understand that various changes and modifications may be made without departing from the scope of protection and spirit of the appended claims, and that the present application is not limited to the exemplary embodiments enumerated in the description.

What is claimed is:

1. A scroll compressor, comprising:

a shell;

a first scroll fixed to the shell, the first scroll comprising a first end plate and a first scroll wrap;

a second scroll, the second scroll comprising a second end plate and a second scroll wrap, and the first scroll wrap extending from the first end plate toward the second end plate and the second scroll wrap extending from the second end plate toward the first end plate, such that the second scroll wrap and the first scroll wrap fit with each other to form a compression cavity for compressing a medium;

an electric motor; and a screw oil pump, driven by the electric motor, a top end of the screw oil pump fitting with the second scroll, and a lower end of the screw oil pump extending into an oil bath located at a bottom of the shell;

wherein, the screw oil pump comprises:

a shaft, which is connected to the electric motor to be rotated and is provided with a first channel extending along an entire length of the shaft for feeding oil, a top end of the shaft being fixed to the second end plate;

a feeding piece, provided with a spirally rising thread; and a cylindrical accommodating piece, which accommodates the feeding piece with a gap between the cylindrical accommodating piece and the feeding piece, wherein, one of the feeding piece and the accommodating piece is fixed to the shaft, and the other one of the feeding piece and the accommodating piece is fixed in the shell, such that oil is fed to the first channel along the thread when the feeding piece and the accommodating piece rotate relatively to each other.

2. The scroll compressor as claimed in claim 1, wherein a bottom end of the shaft is provided with a first fitting groove that has a shape fitting with a top end of the feeding piece, such that the feeding piece is fixed to the bottom end of the shaft in an interference fit manner.

3. The scroll compressor as claimed in claim 2, wherein the feeding piece is provided with:

a through hole, located in a sidewall of the feeding piece and adjacent to the thread; and a second channel, fluidly connecting the through hole to the first channel.

4. The scroll compressor as claimed in claim 3, wherein the accommodating piece is provided with a first radial protrusion on an inner sidewall thereof, and the bottom end of the shaft inserted into the accommodating piece abuts against an end surface of the first radial protrusion; and the accommodating piece further comprises a rolling bearing between the inner sidewall of the accommodating piece and the bottom end of the shaft.

5. The scroll compressor as claimed in claim 4, wherein the through hole is at the same level as the end surface.

6. The scroll compressor as claimed in claim 5, wherein the compressor further comprises a bracket, and the accommodating piece further comprises:

a flange, extending radially outward from an outer sidewall of the accommodating piece and provided with bolt holes for bolting to the bracket of the compressor.

7. The scroll compressor as claimed in claim 1, wherein the accommodating piece is provided with a second radial protrusion, and the bottom end of the shaft is provided with a second fitting groove that has a shape fitting with the second radial protrusion, such that the accommodating piece is fixed to the bottom end of the shaft in an interference fit manner.

8. The scroll compressor as claimed in claim 7, wherein the scroll compressor further comprises:

a fixing bracket, fixed at the bottom of the shell and provided with a fixing groove, the fixing groove being used to accommodate and fix a fixing portion provided at the bottom of the feeding piece.

9. The scroll compressor as claimed in claim 8, wherein the fixing bracket is provided with a first fixing hole, the fixing portion is provided with a second fixing hole, and, when the fixing portion is located in the fixing groove, the first fixing hole and the second fixing hole are aligned with each other, so that a pin is inserted into the first fixing hole and the second fixing hole to fix the fixing portion in the fixing groove.

10. The scroll compressor according to claim 1, wherein the shaft is further provided with an outlet in fluid connection with the first channel for feeding oil in the first channel to a component to be lubricated.

11. The scroll compressor according to claim 1, wherein the thread spirally rises along a direction consistent with a direction along which the shaft rotates.

12. The scroll compressor according to claim 1, wherein the feeding piece is made of metal or engineering plastics.

13. The scroll compressor according to claim 1, wherein the electric motor is connected to a frequency converter through a terminal and a lead, and the frequency converter controls a rotation speed of the electric motor.

14. The scroll compressor according to claim 1, wherein the accommodating piece is provided with a second radial protrusion, and the bottom end of the shaft is provided with a second fitting groove that has a shape fitting with the second radial protrusion, such that the accommodating piece is fixed to the bottom end of the shaft in an interference fit manner, and wherein the electric motor comprises a stator and a rotor, the stator is fixed in the shell, and the rotor is located inside the stator and connected to the shaft to drive the shaft to rotate.

* * * * *